US011248872B1

(12) United States Patent
Black

(10) Patent No.: US 11,248,872 B1
(45) Date of Patent: Feb. 15, 2022

(54) PORTABLE GUN REST WITH ADJUSTABLE STABILITY CONTROL

(71) Applicant: Robert O. Black, Heath, TX (US)

(72) Inventor: Robert O. Black, Heath, TX (US)

( * ) Notice: Subject to any disclaimer, the term of this patent is extended or adjusted under 35 U.S.C. 154(b) by 0 days.

(21) Appl. No.: 17/024,685

(22) Filed: Sep. 17, 2020

Related U.S. Application Data

(60) Provisional application No. 62/901,790, filed on Sep. 17, 2019.

(51) Int. Cl.
*F41A 23/14* (2006.01)
*F41A 23/00* (2006.01)

(52) U.S. Cl.
CPC ..... *F41A 23/14* (2013.01); *F41A 23/005* (2013.01)

(58) Field of Classification Search
CPC ..... F41A 23/005; F41A 23/06; F41A 23/10; F41A 23/14
USPC ..... 42/94; 89/37.01, 37.03, 37.04, 37.11, 89/40.06
See application file for complete search history.

(56) References Cited

U.S. PATENT DOCUMENTS 2,427,365 A * 9/1947 Meister ..... F41A 23/16 269/152
2,642,958 A * 6/1953 Lennon ..... F41A 25/06 188/42
5,937,561 A * 8/1999 Abernethy ..... F41A 23/16 42/94
7,730,824 B1 * 6/2010 Black ..... F41A 23/02 89/37.03
2004/0020097 A1 * 2/2004 Deros ..... F41B 5/1449 42/94
2007/0256346 A1 * 11/2007 Potterfield ..... F41A 23/16 42/94
2010/0170134 A1 * 7/2010 McDonald ..... F41A 23/06 42/94
2011/0197748 A1 * 8/2011 Roberts ..... F41A 23/16 89/37.04
2012/0222344 A1 * 9/2012 Werner ..... F41A 29/00 42/94
2013/0014420 A1 * 1/2013 Bastian, Jr. ..... F41A 23/02 42/94
2018/0224062 A1 * 8/2018 Yokiel ..... F41A 23/06

* cited by examiner

*Primary Examiner* — Bret Hayes
(74) *Attorney, Agent, or Firm* — Guy V. Manning

(57) ABSTRACT

A portable gun rest has a gun mount head which includes a rotator housing assembly for azimuth directional control and a platen elevation mechanism for elevation control. The rotator housing assembly has a stator and a rotator. A rotator brake is operated to selectively restrict movement between the rotator and the rotary housing. The platen elevation mechanism has two or more platens which are secured together with a flat bearing located there-between. An elevation brake is selectively adjustable to push the two platens together with different amounts of force providing selectable torque required to move one platen relative to another. The platens have a lattice-like structure for attenuating vibratory motion.

9 Claims, 7 Drawing Sheets

PORTABLE GUN REST WITH ADJUSTABLE STABILITY CONTROL

CROSS-REFERENCE TO RELATED APPLICATION

The present application is a non-provisional of and claims domestic benefit from U.S. Provisional Patent Application Ser. No. 62/901,790, filed Sep. 17, 2019, entitled "Portable Gun Rest with Adjustable Stability Control," and invented by Robert O. Black, the inventor of the present application.

TECHNICAL FIELD OF THE INVENTION

The present invention relates in general to a portable gun rest, and in particular to a portable gun rest with added stability control.

BACKGROUND OF THE INVENTION

Portable gun rests have been provided for sports hunting, target shooting and sharp shooter use. Portable gun rests usually provide for azimuth and elevation adjustments. Azimuth and elevation are generally polar coordinates, with azimuth referring to a direction in horizontal plane in which a weapon is pointed and elevation referring to an angle between a direction and the horizontal plane. Gun rests typically include a stand, a gun mount head secured to the stand, and a platform fixed to the stand for receiving a firearm. The gun mount head provides relative movement between the platform and the stand, providing control of the azimuth and elevation of the direction in which the weapon is pointed. The stand can be a tripod, a bipod or a single post. The gun mount head is often secured to the stand by a single ⅜ inch diameter threaded bolt. Tracking a target with a fifteen to thirty-five pound firearm on a gun rest on which the gun mount head is secured to a stand with a ⅜ inch diameter threaded bolt results in vibrations which cause significant optical distortion in rifle scopes, resulting in frequent loss of the target viewed through the scopes. This is often made worse due to inadvertent jostling by the user. Additionally, when the firearm is discharged, the resulting percussion provides a sharp jolt the whole gun mount assembly and target acquisition is lost and must be reacquired. Tracking a target and firing the weapon results in multiple harmonic frequencies which require the expense of critical time between shots for the vibrations to dampen and the scope to become stable enough to sufficiently reduce optical distortion to allow reacquisition of the target through a scope.

Heavier gun rests have been provided which restrict movement of the weapon when tracking a target and when fired, providing more restrictive control for maintaining acquisition of the target both during movement of the target and after the weapon is discharged. One such prior art gun rest is the SPEC-REST® gun mount shown in U.S. Pat. No. 7,730,824, entitled Precision Tactical Mount, invented by Robert O. Black, and issued on Jun. 8, 2010. The SPEC-REST® gun mount is a tactical gun rest which, although providing sufficient restrictive control for maintaining acquisition of the target, is heavy and not rapidly deployable, and requires significant space to set up when moving to a new location. Although an excellent gun rest for precision, stationary circumstances, a light weight, rapid deployable gun rest is desirable when rapid deployment and redeployment is required.

SUMMARY OF THE INVENTION

A rapidly deployable, portable gun rest is disclosed having adjustable stability control with vibration dampening for use with a firearm and maintaining acquisition of the target while tracking a target and discharging the firearm. The portable gun rest includes a stand, a gun mount head mounted on top of the stand, and a gun mount platform. The stand is preferably a tripod stand. The gun mount head includes a rotator housing assembly for controlling azimuth and a platen elevation mechanism for controlling elevation. The rotator housing assembly has a stator and a rotator. The stator is fixedly secured to the stand and provides a housing for the rotator. A bushing formed of polymeric material is press fit onto the rotator and pivotally secured within the stator. A rotator brake is operated to selectively restrict movement between the rotator and the stator. The platen elevation mechanism has two platens which are secured together with a flat bearing formed of polymeric material located there-between. An elevation brake is selectively adjustable to pull the two platens together with different amounts of force providing selectable torque required to move one platen relative to another. The platform is mounted on top of the platen elevation mechanism and has two yokes receiving the forward portion of the stock of a firearm to secure the firearm to the gun rest. Adjustment of the rotator brake and the elevation brake provide adjustable drag over respective surface areas so that the user may comfortably move the weapon along various azimuth directions and elevation settings, and the azimuth and elevation settings will be maintained. The brakes may be further engaged to lock the gun mount head in a fixed position. The platens have a spine and rib structure with recesses located between the spine and the ribs to promote attenuation of vibration of the gun rest, while providing support structure to the platen surfaces to assure quick lockup. The spine and ribs thus reinforce the surfaces they are machined adjacent to to assure proper support.

DESCRIPTION OF THE DRAWINGS

For a more complete understanding of the present disclosure and the advantages thereof, reference is now made to the following description taken in conjunction with the accompanying Drawings in which

FIG. 1 is a perspective view of a portable gun rest securing a firearm in a selected direction according to the present disclosure;

FIG. 2 is a perspective view of a gun mount head used in the portable gun rest of FIG. 1 for controlling both the azimuth and the elevation of the direction in which the firearm is pointed;

FIG. 3 is an exploded, perspective view of the gun mount head of FIG. 2;

FIG. 4 is a perspective view of an alternative gun mount head which has a platen elevation mechanism which includes three platens;

FIG. 5 is an exploded, perspective view of the platen elevation mechanism of FIG. 4;

FIG. 6 is an exploded, perspective view of the gun mount head of FIG. 4, showing components of the platen elevation mechanism and a rotator housing assembly;

FIG. 7 is a right side perspective view of a second alternative gun mount which has a platen elevation mechanism formed of two platens which are pivotally secured together;

FIG. 8 is a left side perspective view of the second alternative gun mount of FIG. 7; and FIGS. 9 and 10 are exploded perspective views taken from different directions, showing the second alternative gun mount of FIGS. 7 and 8.

DETAILED DESCRIPTION OF THE INVENTION

Figure 1:
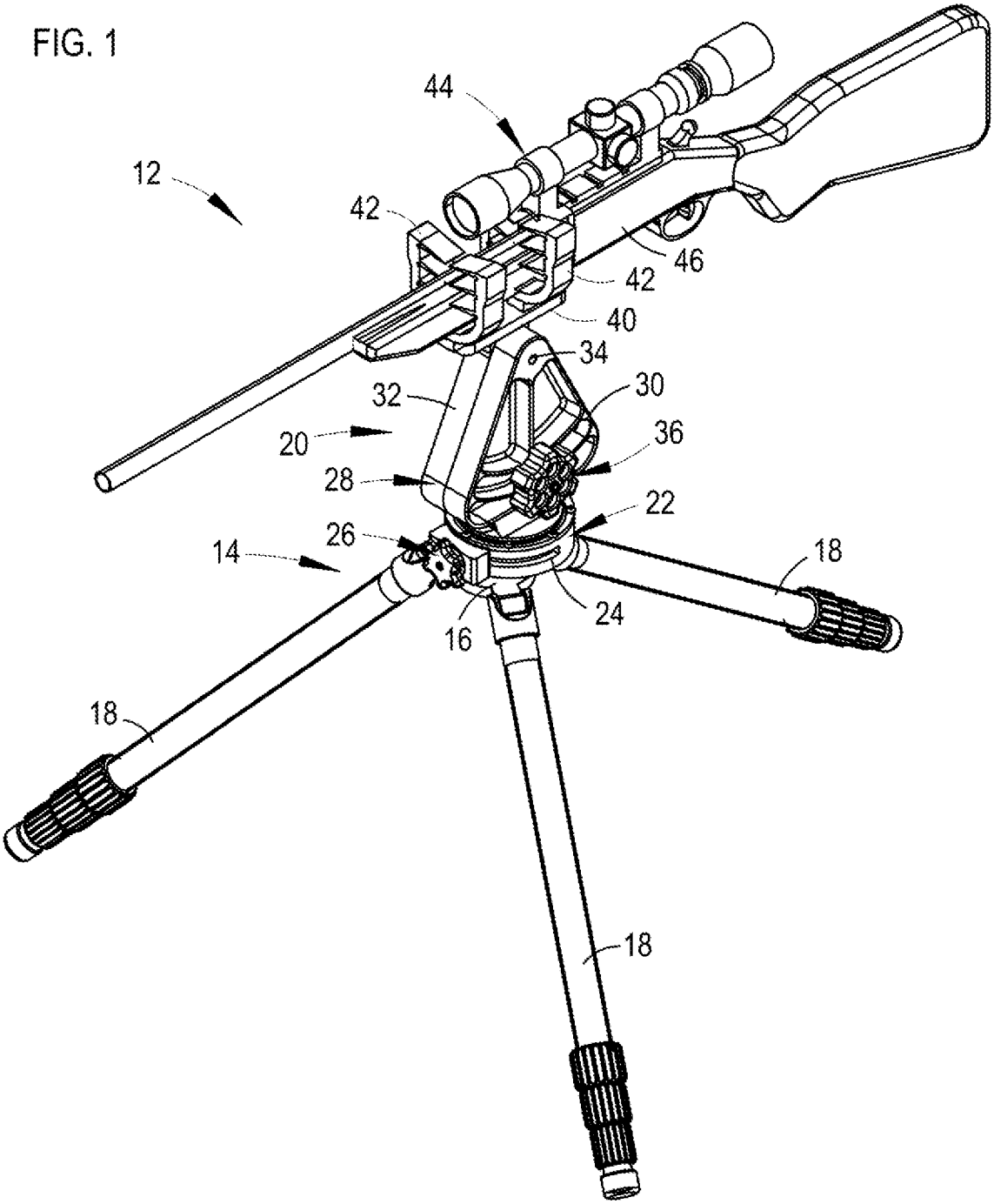
FIGS. 1 through 10 show various aspects for portable gun rest with adjustable stability control made according to the present disclosure, as set forth below.

FIG. 1 is a perspective view of a portable gun rest 12 which may be rapidly deployed for securing a firearm in a selected direction according to the present disclosure. The portable gun rest 12 includes a stand 14 which is preferably a tripod having three legs which are mounted to a hub 16. A gun mount head 20 includes a rotary mechanism 22 and a platen elevation mechanism 28. The rotary mechanism 22 is mounted to the hub 16, preferably in a fixed position relative to the hub. The rotary mechanism 22 has a rotator housing assembly 24 and a rotator brake 26. The rotary mechanism 22 provides azimuth adjustment. The platen elevation mechanism 28 is mounted to the rotary mechanism 22 and provides elevation adjustment. The platen elevation mechanism 28 has a stationary platen 30 and a moveable platen 32 which are pivotally secured together on one end. The stationary platen 30 is mounted directly to the rotary mechanism 22 and rotates relative to the hub 16. An elevation brake 36 is selectively adjustable to provide frictional engagement between the stationary platen 30 and the moveable platen 32 which provides selectable resistance to movement. A platform 40 is mounted on top the platen elevation mechanism 28, directly to and in fixed relation with the moveable platen 32. Two yokes 42 are mounted to the platform 40 and the firearm 44 has a stock 46 which is inserted within the yokes 42 to retain the firearm 44 in fixed relation to the platform 40 and the platen elevation mechanism 28.

Figure 2:
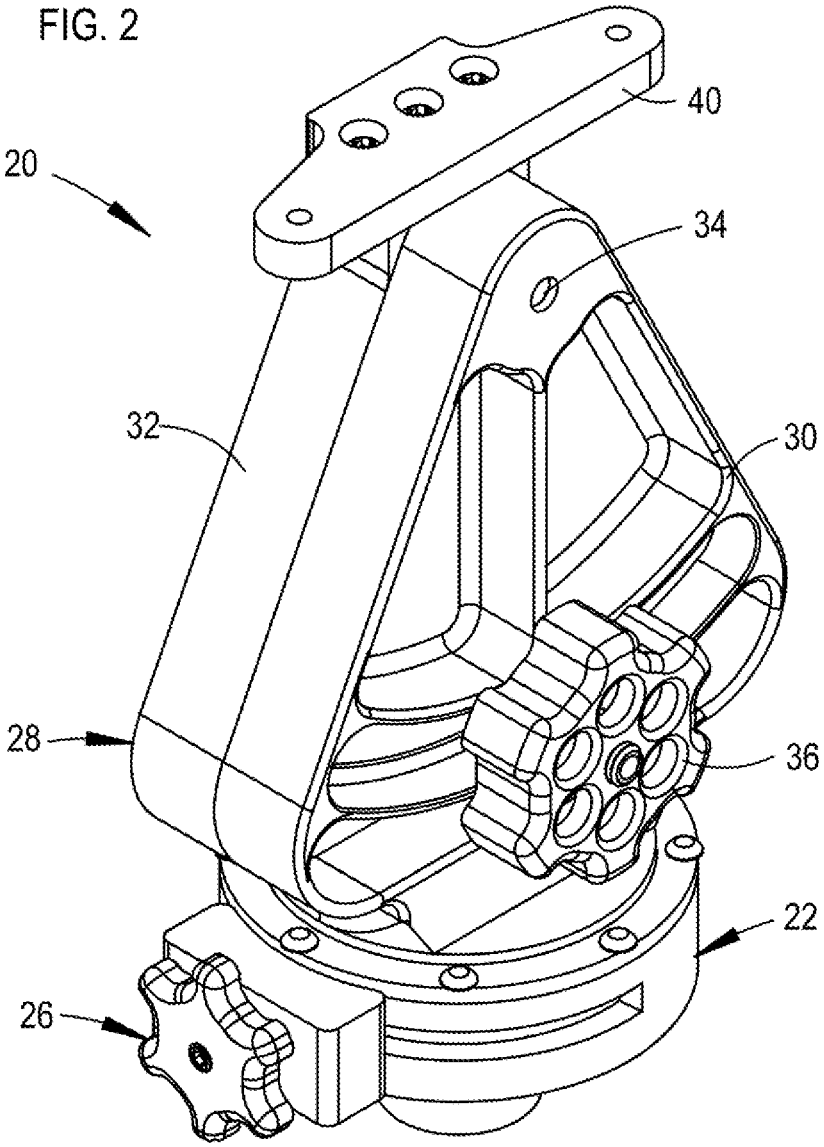

FIG. 2 is a perspective view of a gun mount head 20 used in the portable gun rest of FIG. 1 for selectively controlling both azimuth and elevation for the selected directions in which the firearm is pointed. The gun mount head 20 is shown after removal from the stand 14 and removal of the yokes 42 and firearm 44 from the platform 20. The gun mount head 20 is shown including the rotary mechanism 22 to provide azimuth adjustment. The rotary mechanism 22 has a rotator housing assembly 24 and a rotator brake 26. The rotator brake 26 provides frictional or adjustable pushing engagement in the rotary mechanism 22. The platen elevation mechanism 28 is shown mounted atop the rotary mechanism 22, with the stationary platen 30 mounted directly to the rotary mechanism 22. The moveable platen 32 is rotatably mounted to the stationary platen 30 by the bearing pin 34, which is located at the apex of the two triangular shaped platens 30 and 32. The elevation brake 36 adjusts the pulling engagement between the stationary platen 30 and the moveable platen 32. The platform 40 is shown secured atop the stationary platen 30.

Figure 3:
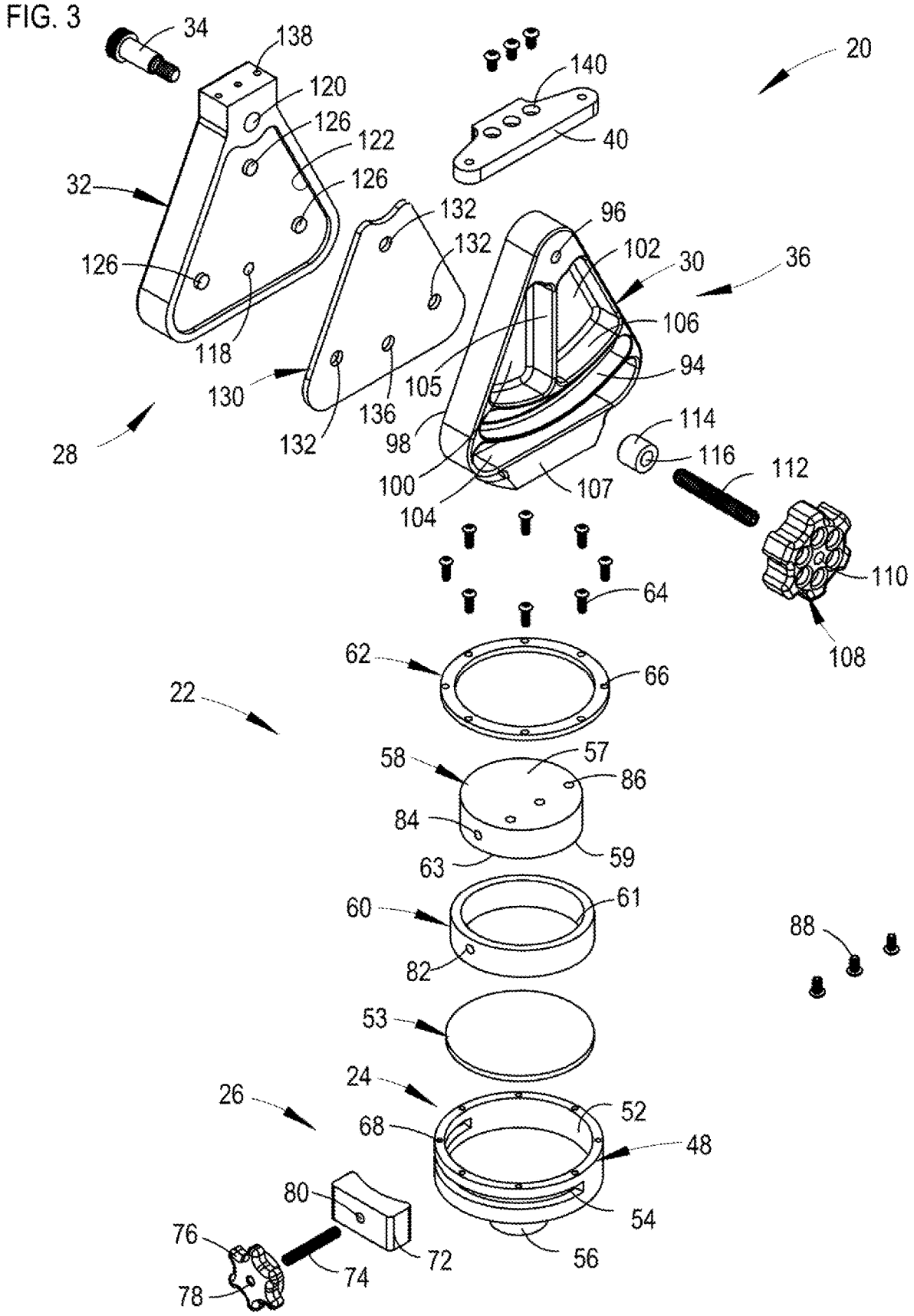

FIG. 3 is an exploded, perspective view of the gun mount head 20 of FIG. 2. The rotary mechanism 22 has a rotator housing assembly 24 which includes a stator 48 and a rotator 58. The stator 48 preferably has an annular-shaped upper end 50 and a cylindrically shaped lower end 56. A recess 52 is formed in an upward end 50 and is cylindrically shaped for rotary mounting of the rotator 58 therein. A slot 54 is formed to circumferentially extend into the exterior circumference of the cylindrical sidewall of the upper end 50 for slidably passing a bolt 74, described below. A lower end 56 provides a mounting post for securing the stator 48 in fixed relation to the hub 16 of the stand 14 (shown in FIG. 1). Preferably, the lower end 56 is formed of such a shape as to interfit with the shape in the hub 16 (shown in FIG. 1), and secures the stator 48 in fixed relation to the hub 16 (shown in FIG. 1).

A bushing 60 is annular shaped and rotatably fits within the recess 52 of the stator 48 with a clearance there-between such that the bushing 60 is rotatable within the recess 52. An aperture 82 extends through the sidewall of the bushing 60. The bushing 60 has a centrally disposed mounting hole 61 which is sized for receiving the rotator 58 in a press fit engagement. The bushing 60 and the rotator 58 are retained in the recess 52 of the stator 48 by a lock ring 62. The lock ring 62 has through holes 66 for passing threaded fasteners 64 threadingly secure within threaded apertures 68 formed into the upper rim of the stator 48. The height of the bushing 60 is preferably shorter than the height of the rotator 58, and the bushing 60 is press fit onto the rotator 60 such that the rotator 58 will extend slightly beneath and slightly above the opposite ends of the bushing 60 such that the respective opposite ends of the bushing 60 never contact either the lock ring 62 or a bottom surface of the recess 52 formed into the stator 48. A planer bearing 53 which is preferably a circular disc shape fits within and against the bottom of the recess 52 to provide a bearing surface for the lower terminal end 59 of the rotator 58 to engage. The planer bearing 53 is preferably formed of a polymer such as Delrin® or Teflon®. The bushing 60 is preferably formed of a polymer, preferably PVC, and the stator 48 and the rotator 58 are formed of metal, preferably aluminum. Thus the dynamic contact surfaces, or moving contact surfaces, for rotating the rotator 58 do not have metal-to-metal contact, but instead at least one of the contact surfaces will be formed of the polymer from which the bushing 60 is made. The busing 60 provides a radial journal bearing for slidably engaging the sidewalls of the stator 50 (journal housing).

The rotator 58 is cylindrically shaped with an upper terminal end 57 and a lower terminal end 59. The upper terminal end 57 of the rotator 58 is planar shaped. A recess 63 is formed into the underside of the rotator 58 such that the lower terminal end 59 is annular shaped. Apertures 86 are formed through the upper terminal end 57 and extend into the recess 63. Threaded fasteners 88 are mounted to extend from the recess 63, through the apertures 86 and into threaded holes 92 located in a mounting boss 90 formed in the lower end of the stationary platen 30 for mounting the stationary platen 30 in fixed relation to the rotator 58.

The rotator brake 26 includes a brake shoe 72, a bolt 74 and a knob 76 which provides a grip device. The threaded aperture 78 is formed in the central portion of the knob 76 for receipt of the first end of the bolt 74. An aperture 80 is provided in the brake shoe 72. The rotator 58 has the aperture 84 which is threaded for receiving a second end of the bolt 74. The bolt 74 will pass through the aperture 80, through and the slot 54, through the aperture 82 and into the threaded hole 84 formed into the rotator 58. The bolt 74 has a second end which is threaded for threadingly securing to the threaded hole 84.

The brake shoe 72 is formed of a polymer, preferably Delrin®. In the present disclosure, it preferable that no two adjacent moving metal parts make contact with each other; instead there is always a polymeric member in-between. Each moving engagement between parts includes at least one of the parts being formed of a polymeric member such as Delrin or PVC to reduce friction between the relatively moving parts. The bushing 60 is formed of a polymer, preferably PVC. The brake shoe 72, the lock ring 62 and the flat bearing 130 are formed of a polymer, preferably Delrin®. The polymeric members are disposed adjacent to polished metal surfaces.

The stationary platen 30 has a lower end from which is extends a mounting boss 90. The mounting boss 90 has a plurality of threaded holes which are not shown for receipt of the fasteners 88 which extend upward through the apertures 86 located in the top of the rotator 58. Formed into a vertical plane of the stationary platen 30 is a bushing slot 94 which is of arcuate shape. The arcuate shape of the bushing slot 94 extends in an arc of a semicircular shape having a center located at the central portion of a threaded hole 96 about which the moveable platen 32 will rotate when secured to the stationary platen 30 with the bearing pin 34. The bearing pin 34 is preferably a shoulder bolt with the smooth part of the shoulder bolt fitting within the through hole 120 in the upper end of the moveable platen 32. A planar flat friction surface 98 is defined on the opposite, planar, vertical side of the stationary platen 30. On the outward vertical side of the stationary platen 30, a plurality of recesses 100, 102, and 104 are formed into the outward vertical sidewall of the moveable platen 32 to define a spine 105, which is shown extending vertically, and ribs 106 extending laterally on either side of the spine 105. This interconnected framework of a spine 105 and the ribs 106 are located adjacent to and formed on a flat, planar sidewall which provides a solid planar friction surface 98 for the stationary platen 30. The recesses 100, 102 and 104, in combination with the spine 105 and the ribs 106, provide for shock absorption to prevent harmonic vibrations from interfering with the optical stability of the scope mounted to a firearm 44 secured to the gun mount head 20. A mounting boss 107 extends from the lower end of the stationary platen 30 for securing to the upper terminal end 57 of the rotator 58.

The elevation brake 36 is provided for controlling elevation, by braking movement of the moveable platen 32 about the bearing pin 34. The elevation brake 36 has a knob 108 to provide a grip, with a threaded hole 110 formed in the middle of the knob 108. A bolt 112 is threaded and has a first end for threadingly securing within the threaded hole 110 of the knob 108. The bolt 112 has a second end for threadingly securing within a threaded hole 118 formed into a lower central portion of the moveable platen 32. The bolt 112 passes through a bushing having a hole 116. The bushing 114 fits within the arcuately shaped bushing slot 94 which provides for free movement of the slot 94 of the stationary platen 30 relative to the bolt 112 of the elevation brake 36.

The moveable platen 32 has an inward vertical side with a recess 122 formed therein and mounting protrusions 126 which extending laterally from the inner surface of the recess 122. A flat bearing 130 is formed with a polymer such as Delrin®, and has mounting holes apertures 132 for receiving the mounting protrusions 126 to secure a flat bearing 130 within the recess 122. An aperture 136 is provided for passing the threaded bolt 112 through the bushing and into the threaded hole 118 in the moveable platen for pulling the platen 32 and the flat bearing 13 against the planar friction surface provided by the backside of the stationary platen 30. The flat bearing 130 will be slightly thicker than the lip located adjacent to recess 122 so that it protrudes outward from the inward vertical wall of the moveable platen 32 and engages against the inward flat planar surface of the vertical wall 98 of the stationary platen 30. The knob 108 is rotated to rotate the bolt 112 and pull the moveable platen 32 against the stationary platen 30, with the flat bearing 130 disposed there between and providing the friction engagement thereof. The flat bearing 130 is formed of a polymer which will also reduce the vibratory harmonics to preserve optical stability of the scope mounted to the firearm 44. The upper end of the moveable platen 32 has a flat end into which threaded holes 138 are formed. The platform 40 is mounted atop the moveable platen 32 by means of threaded fasteners 142 which extend through holes 140 formed in the platform 40 and into the threaded holes 138. The moveable platen 32 has an outer vertical wall which has a flat surface such as the outer vertical wall of the stationary platen 30, having a framework of a spine 105 and laterally extending ribs which attenuates vibration. The recesses formed into the movable platen 30 absorb vibratory energy will attenuate harmonic frequencies and provide increased optical stability for a scope mounted atop the firearm 44.

The stationary platen 30 and the moveable platen 32 are both generally triangular shaped, each having profiles which are of the shapes of isosceles triangles, and preferably equilateral triangles. The stationary platen 30 and the moveable platen 32 are pivotally connected together by the bearing pin 34 at positions which are proximate to the respective vertices of the platens 30 and 32, providing surface areas proximate to the bases of the generally triangular shaped platens 30 and 32 which are of a large surface area located a distance from the respective vertices about which the moveable platen 32 rotates relative to the stationary platen 30. The larger surface provides a lower pressure, by spreading the force pulling the two platens together over a larger surface, and maximizes the distance of the base of the profile from the vertices which increases the moment arm of the resistance between the two platens 30 and 32 acting on the moveable platen 32 to prevent the moveable platen 32 from moving relative to the stationary platen 30. Preferably the lower edge of the contact surface area of the moveable platen 32 is separated from the pivot pin 34 by a distance which is not less than the length of the lower edge of the contact surface area of the movable platen 32.

Similarly, the lower edge of the contact surface area of the stationary platen 30 separated from the pivot pin 34 by a distance which is not less than the length of the lower edge of the contact surface area of the stationary platen 30. The length provides a moment arm at which the frictional engagement occurs between the stationary platen 30 and the movable platen 32, which as result of the length of the moment arm accordingly decreases the force at which the two platens 30 and 32 must be pulled together due to the moment arm. This lower force is then spread over a larger surface area which reduces the actual pressure, or the value for the force per unit area, reducing the resulting stress applied to the parts which then prevents galling effects from reducing the smoothness at which the moveable platen 32 moves over the stationary platen 30. This smoother movement of the moveable platen 32 relative to the stationary platen 30 greatly reduces vibratory motion and improves optical stability. This increased smoothness resulting from the platens being triangular shaped, preferably equilateral triangular in shapes, is combined with using a flat liner 130 and a bushing 60 which are formed of polymeric materials to provide a polymer material sliding on a polished metal surface. This further reduces vibratory motion and improves optical stability, such that the weapon may be easily aimed and track a target without losing target acquisition due to vibratory oscillations and other movement.

Figure 4:
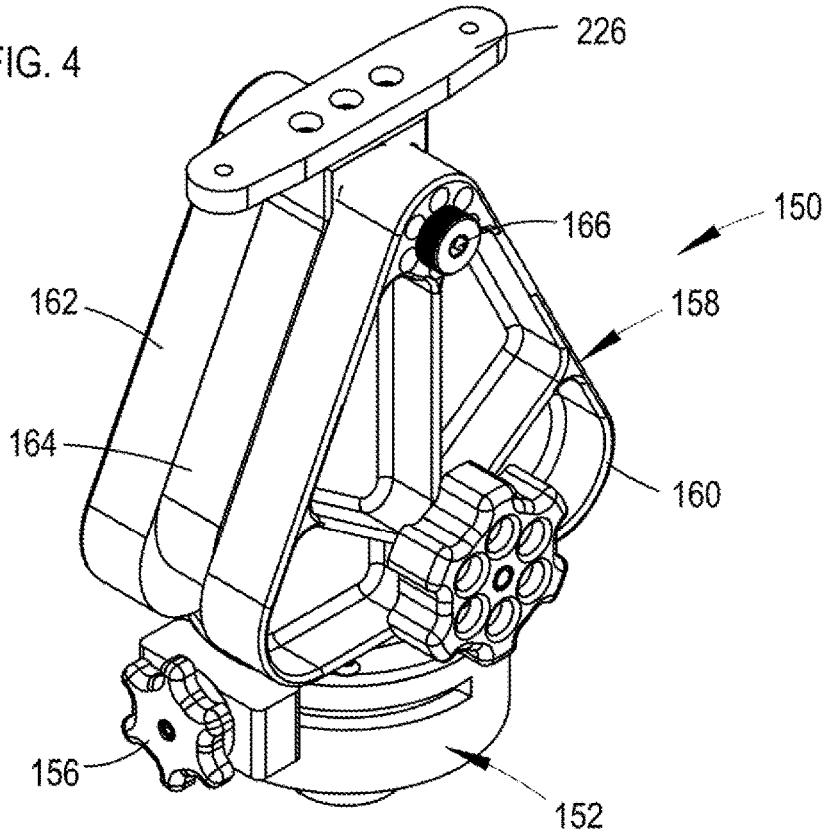
Figure 5:
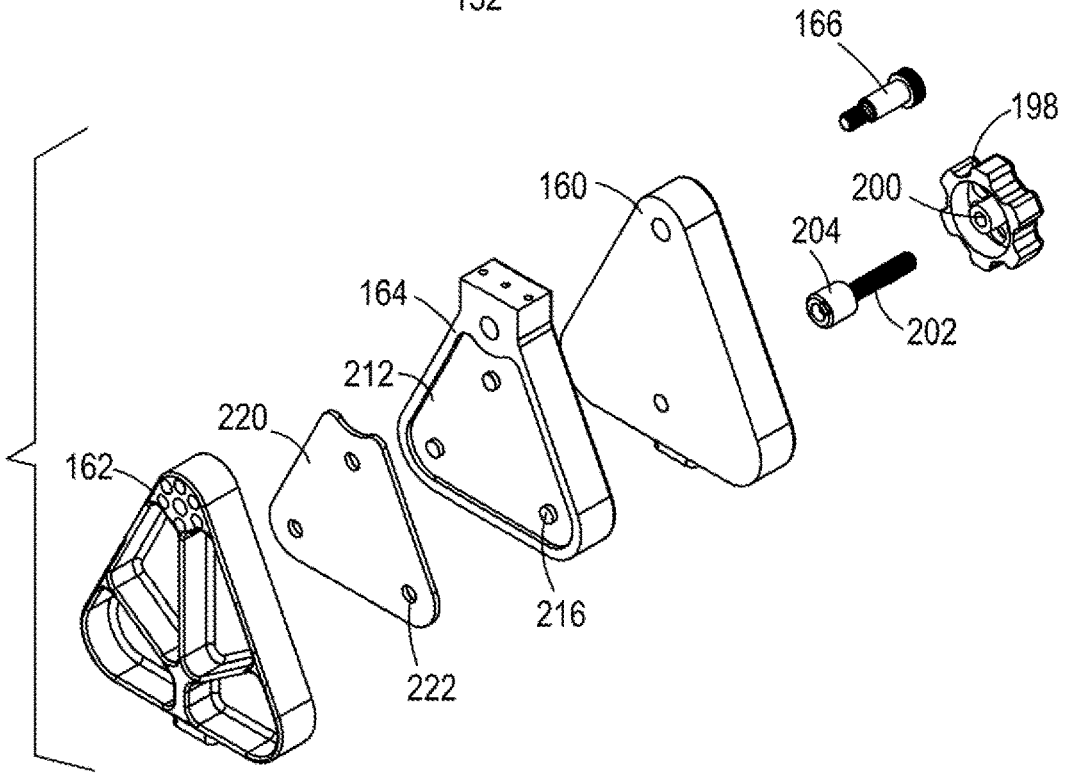

FIG. 4 is a perspective view and FIG. 5 is an exploded, perspective view of an alternative gun mount head 150 having a rotary mechanism 152 which includes a rotator housing assembly 154 and a rotator brake 156. The gun mount head 150 also includes a platen elevation mechanism 158. The platen elevation mechanism 158 includes a stationary platen 160, a stationary platen 162 and a moveable platen 164 which is rotatably moveable between the stationary platens 160 and 162. A bearing pin 166 secures the moveable platen 164 between the stationary platen 160 and the stationary platen 162. The stationary platen 160 has a through hole for receiving the bearing pin 166. The moveable platen 164 has a through hole, and the stationary platen 162 has a threaded hole for threadingly securing the threaded end of the bearing pin 166. The bearing pin 166 is preferably provided by a shoulder bolt with the smooth portion of the bearing pin 166 fitting within the aperture passing through the stationary platen 160 and the aperture passing through the moveable platen 164. An elevation brake 168 is provided for controlling personal resistance for the moveable platen 164 rotatably moving between the stationary platen 160 and the stationary platen 162. A platform 172 is provided atop the moveable platen 164 for mounting the yokes 42 (shown in FIG. 1).

Figure 6:
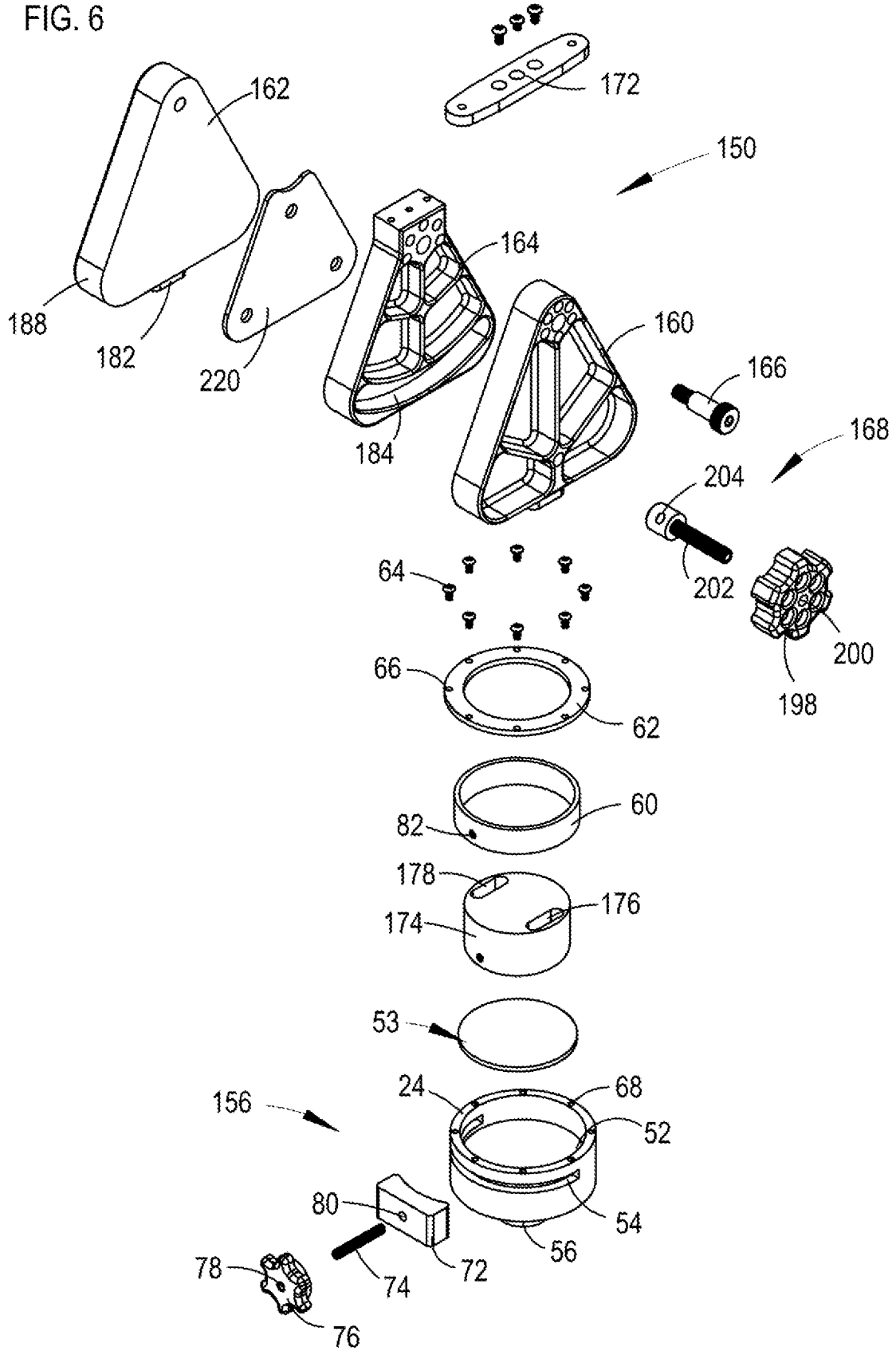

FIG. 6 is an exploded, perspective view of the gun mount head of FIGS. 4 and 5, viewed from the same angle as FIG. 4 and an angle orthogonal to the view of FIG. 5. FIG. 6 also shows a rotator housing assembly to which the platen elevation mechanism is mounted. A rotator 174 is provided in FIG. 6 rather than the rotator 58 of FIG. 3, otherwise the rotary mechanism 152 is the same as that shown in FIG. 3. The rotator 174 has a mounting hole 176 and a mounting hole 178 spaced apart on opposite sides of the upper end of the rotator 174. A mounting boss 180 extends downward from the stationary platen 160 for being received within the mounting hole 176, and a mounting boss 182 extends downward from the stationary platen 162 for being received within the mounting hole 178 for mounting the stationary platens 160 and 162 to the rotator 174 and provide the rotary mechanism 152. Preferably, threaded fasteners will extend through the bottom of the rotator 174 into the threaded holes and the mounting bosses 180 and 182 to fixedly secure the stationary platen 160 and the stationary platen 162 to the rotator 174. A bushing slot 184 of arcuate shape is formed into the moveable platen 164. A threaded hole 186 extends through a central portion of the stationary platen 160. A planar friction surface 188 is defined on the back side of the stationary platen 162. Recesses 190, 192 and 194 are formed into those portions of the stationary platen 160, the stationary platen 162, and the moveable platen 164 define a framework of spins 195 and ribs 196 for attenuating vibration to enhance optical stability.

The elevation brake 168 includes a knob 198 which provides a hand grip, having a threaded hole 200 formed in the central portion thereof. A threaded bolt 202 fits within and is threadingly secured to threaded hole 200 such that the knob 198 may be used to rotate the bolt 202. A bushing 206 is secured in a fixed position on the opposite end of the bolt 202. The bolt 202 will extend through the threaded hole 186 in a central portion of the stationary platen 160 with the bushing 204 secured at the opposite end on the opposite side of the stationary platen 160 from the knob 198. When the platens 160, 162 and 164 are assembled together, the bushing 204 will fit within the arcuately shaped bushing slot 184. The knob 198 provides a hand grip for rotating the bolt 202 within the threaded hole 186 to push or retract the bushing 204 against the end face of the moveable platen 164 from within the bushing slot 184. Pushing the moveable platen 164 with the bushing 206 will urge the flat bearing 220 against the planar fiction surface 188 on the back side or interior side of the stationary platen 162. The amount of force at which the bushing 204 is pressing against the vertical sidewall of the moveable platen 164 will provide an adjustable, pushing engagement for resisting rotation of the moveable platen 164 relative to the stationary platens 160 and 162. Once a firearm is positioned at a desired elevation, the bolt 202 will be further tightened using the knob 198 to lock the moveable platen 164 in the desired position, with the firearm at the desired elevation. The back side 224 of the stationary platen 160 has protrusions 216. A flat bearing 220, formed of a polymer, preferably Delrin®, has apertures 222 for fitting and registration with the protrusions 216 and the flat bearing 220 is disposed in the recess 212 on the back side 224 of the stationary platen 160.

Figure 7:
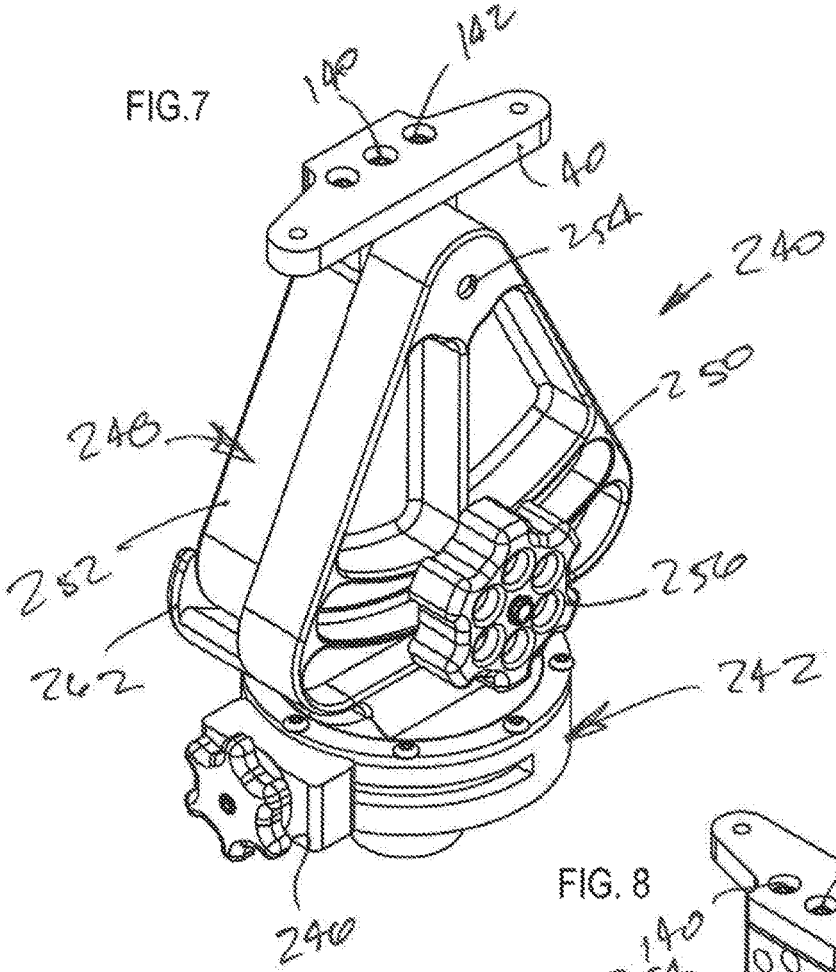
Figure 8:
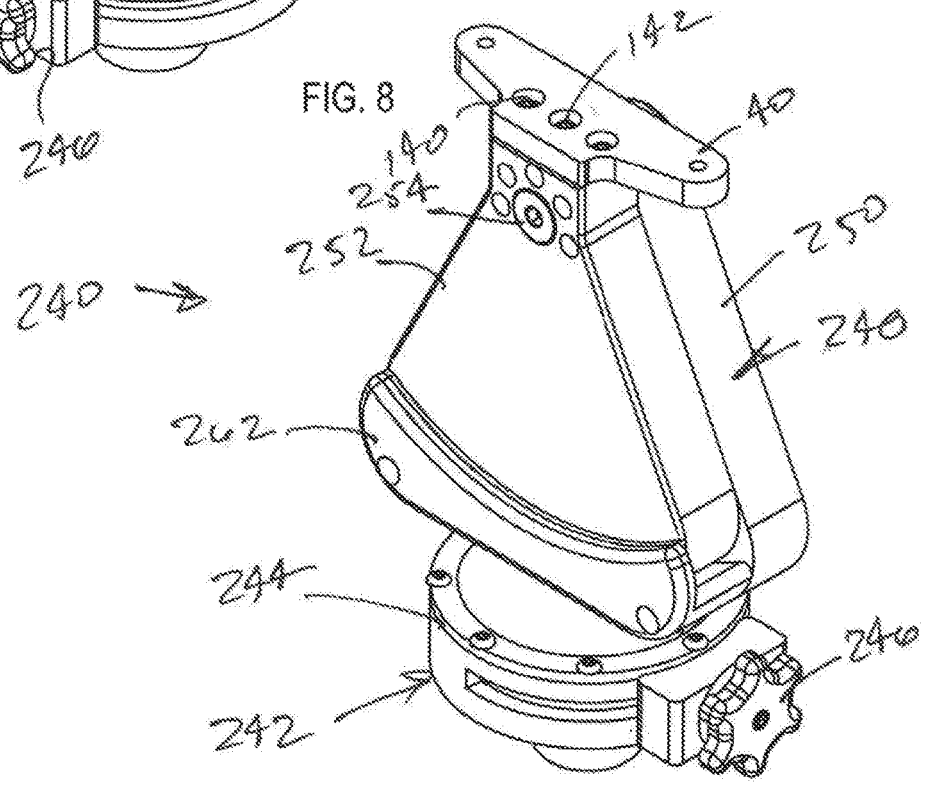

FIGS. 7 and 8 are perspective views of an alternative gun mount head 240 as viewed from two orthogonal directions. The gun mount head 240 has two platens 250 and 252 which control elevation and which are mounted to a rotary mechanism 242 for controlling azimuth. The rotary mechanism 242 includes a rotator housing assembly 244 and a rotator brake 246. The gun mount head 240 also includes a platen elevation mechanism 248 which has a stationary platen 250 and a moveable platen 252 which is rotatably secured to the stationary platen 250 by a bearing pin 254. An elevation brake 256 provides control over frictional resistance preventing movement between the movable platen 252 and the stationary platen 250. The platform 40 is mounted atop the moveable platen 252.

Figure 9:
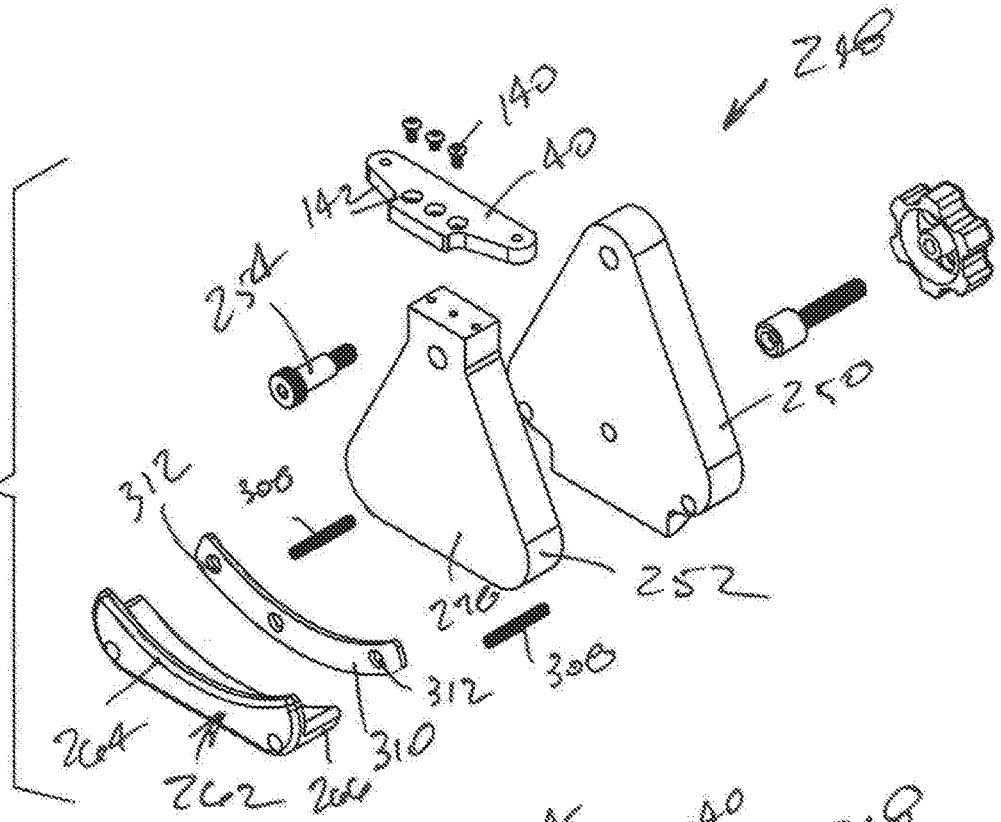
Figure 10:
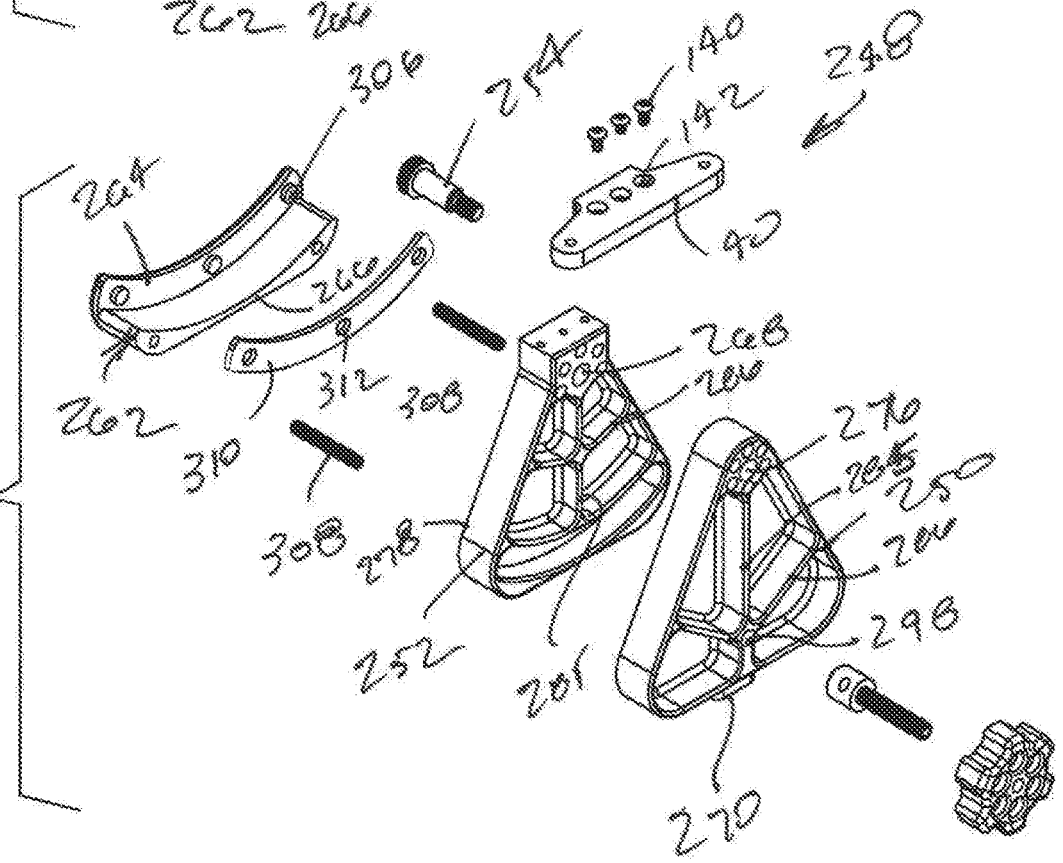

FIGS. 9 and 10 are exploded perspective views taken from different directions, showing the second alternative gun mount head 240 of FIGS. 7 and 8. The stationary platen 250 has a mounting boss 270 which fits within one of the mounting holes 176 and 178 of the rotator 174. A through hole 268 extends through the upper portion of the moveable platen 252. The bearing pin 254 extends to through hole 268 and into a threaded hole 276 in an upper portion of the stationary platen 250. The planar friction surface 278 is defined on the back side of the moveable platen 252. Recesses 282 and 284 are formed into the outward side of the stationary platen 250 and the inward side of the moveable platen 252 to define a framework of ribs providing a lattice structure 286 for attenuating vibration to provide optical stability for a scope mounted to a firearm secured to the gun mount head 250. The elevation brake 256 includes a knob 288 which provides a hand grip. A threaded hole 290 is centrally disposed within a knob 288. A bolt 292 is threaded and is threadingly secured within the knob 288 to the tightness in which the knob 288 may be used to turn the bolt 292. A lock screw 296 is used to make sure the bushing 294 does not come loose from the bolt 292. The bushing 294 will fit within the bushing slot 274 and push against the planar frictions surface 278 on the back side of the moveable platen 252 to push it into a flat bearing 310 mounted to a shoe 304.

The shoe 262 has an arcuately shaped, mounting boss 266 which extends horizontally and beneath the lower end of the moveable platen 252. A sidewall 264 extends vertically upward and to one side of a lower end of the planar, polished friction surface 278 located on the outward side of the moveable platen 252. The shoe 262 has protrusions 306 which will extend in a pattern for fitting within apertures 312 and a flat bearing 310. Preferably, the flat bearing 310 is formed with a polymer, such as Delrin®. Two bolts 300 extend between the shoe 262 and the stationary platen 250, located beneath the movable platen 252. The bolts 300 mount the shoe 262 in fixed relation to the stationary platen 250. Threaded holes 316 are formed into the mounting boss 266 of the shoe 262, spaced apart on one side of the shoe 262. Threaded holes 314 are formed in the bosses formed into the lower end of the stationary platen 250, spaced apart and in registration with. The bolts 300 extend from the threaded holes 314 in the mounting boss 266, underneath the moveable platen 252 and into the threaded holes 314 to secure the shoe in fixed relation to the stationary platen 250.

The present invention provides advantages of a rapidly deployable, portable gun rest having adjustable stability control and vibration dampening. The portable gun rest has a tripod stand, and a gun mount head which is mounted to the tripod stand. The gun mount head includes a rotator housing assembly for azimuth directional control and a platen elevation mechanism for elevation control. The rotator housing assembly has a stator and a rotator. A rotator brake is operated to selectively restrict movement between the rotator and the rotary housing. The platen elevation mechanism has two or more platens which are secured together with a flat bearing located there-between. An elevation brake is selectively adjustable to push the two platens together with different amounts of force providing selectable torque required to move one platen relative to another. The platens have a lattice-like structure of spines and laterally extending ribs for attenuating vibratory motion which enhances a shooter's ability to maintain acquisition of a target in both tracking a target and after discharging a firearm.

Although the preferred embodiment has been described in detail, it should be understood that various changes, substitutions and alterations can be made therein without departing from the spirit and scope of the invention as defined by the appended claims.

What is claimed is:

1. A portable gun rest comprising:

a stand;

a gun mount head secured in fixed relation to said stand, said gun mount head having a rotator housing assembly for controlling azimuth and a platen elevation mechanism for controlling elevation;

said rotator housing assembly having a stator and a rotator, with said stator mounted in fixed relation to said stand and said rotator pivotally secured to said stator for angularly rotating relative to said stator;

said platen elevation mechanism having a stationary platen and a moveable platen, wherein said stationary platen is mounted in fixed relation to said rotator and said moveable platen is secured in movable relation to said stationary platen;

a rotator brake having a brake shoe selectively pressed against said stator to selectively restrict movement of the rotator relative to the rotator housing;

an elevation brake selectively adjustable to push the two platens together with different amounts of force to thereby provide selectable torque required to move one platen relative to another; and a platform mounted atop of the platen elevation mechanism and having two yokes configured for securing a firearm to the gun rest;

wherein adjustment of the rotator brake and the elevation brake provide adjustable drag over respective surface areas so that a user may comfortably move the firearm along various azimuth directions and elevation settings, and the azimuth and elevation settings will be maintained.

2. The portable gun rest according to claim 1 further comprising a flat bearing formed of polymer which is disposed between said moveable platen and said stationary platen, said flat bearing being mounted to a first one of said moveable platen and said stationary platen, and engaging the other of said moveable platen and said stationary platen in frictional engagement for preventing relative movement there-between.

3. The portable gun rest according to claim 1, wherein the platens have a lattice-like structure with ribs and recesses between said ribs to promote attenuation of vibrations from movement of the gun rest and from discharging the firearm.

4. The portable gun rest according to claim 1 further comprising a bushing formed of polymer which is disposed between said stator and said rotator for providing a contact surface between said stator and said rotator.

5. The portable gun rest according to claim 4 wherein said bushing is press fit onto said rotator, and height of said bushing is longer than said rotator such that only the bushing engages said stator and a retainer ring and not said rotator.

6. The portable gun rest according to claim 4 wherein said polymer is polyvinyl chloride.

7. The portable gun rest according to claim 1, wherein said stand comprises a tripod stand.

8. A portable gun rest comprising:

a stand;

a gun mount head secured in fixed relation to said stand, said gun mount head having an azimuth-controlling rotator housing assembly having a stator mounted in fixed relation to said stand; and a rotator pivotally secured to said stator; and an elevation-controlling platen elevation mechanism having a stationary platen mounted in fixed relation to said rotator and a moveable platen secured in movable relation to said stationary platen;

a rotator brake having a brake shoe selectively bearing against said stator to selectively restrict movement of the rotator relative to the rotator housing assembly;

an elevation brake selectively adjustable to push said stationary platen and said movable platen together with different amounts of force; and a platform mounted atop the platen elevation mechanism and having two yokes configured to secure a firearm to the gun rest;

wherein adjustment of the rotator brake and the elevation brake provide adjustable drag over respective surface areas, enabling a user comfortably to move the firearm along variable azimuth directions and elevation settings while maintaining said azimuth and elevation settings.

9. A portable gun rest comprising:

a stand;

a gun mount head secured in fixed relation to said stand, said gun mount head having an azimuth-controlling rotator housing assembly having a stator mounted in fixed relation to said stand; and a rotator pivotally secured to said stator;

an elevation-controlling platen elevation mechanism having a stationary platen mounted in fixed relation to said rotator; and a moveable platen secured in movable relation to said stationary platen;

a rotator brake having a brake shoe selectively bearing against said stator;

an elevation brake selectively adjustable to push said stationary platen and said movable platen together; and a platform mounted atop the platen elevation mechanism and having two yokes configured to secure a firearm to the gun rest.

* * * * *